US007062921B2

(12) United States Patent
Jeng et al.

(10) Patent No.: US 7,062,921 B2
(45) Date of Patent: Jun. 20, 2006

(54) MULTI-STAGE THERMOACOUSTIC DEVICE

(75) Inventors: Ming-Shan Jeng, Taoyuan (TW); Ya-Wen Chou, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 334 days.

(21) Appl. No.: 10/330,140

(22) Filed: Dec. 30, 2002

(65) Prior Publication Data

US 2004/0123979 A1 Jul. 1, 2004

(51) Int. Cl.
*F25B 9/00* (2006.01)
*F01B 29/10* (2006.01)

(52) U.S. Cl. ..... 62/6; 60/520

(58) Field of Classification Search ..... 62/6, 62/335; 60/520
See application file for complete search history.

(56) References Cited

U.S. PATENT DOCUMENTS 5,339,640 A * 8/1994 Reinke ..... 62/6
5,456,082 A * 10/1995 Keolian et al. ..... 62/6
5,647,216 A * 7/1997 Garrett ..... 62/6
5,892,293 A * 4/1999 Lucas ..... 290/1 R
6,389,819 B1 * 5/2002 Zhu et al. ..... 62/6
6,571,552 B1 * 6/2003 Ban et al. ..... 60/312
6,574,968 B1 * 6/2003 Symko et al. ..... 62/6
6,658,862 B1 * 12/2003 Swift et al. ..... 62/6

* cited by examiner

*Primary Examiner*—William C. Doerrler
(74) *Attorney, Agent, or Firm*—Birch, Stewart, Kolasch & Birch, LLP

(57) ABSTRACT

A multi-stage thermoacoustic device includes a resonance tube mounted therein a plurality of stacks and a plurality of heat exchangers interlaid with each other adjacent to a second end of the resonance tube. A working fluid is filled in the resonance tube. A driver mounted on a first end of the resonance tube drives the working fluid oscillate in the resonance tube, the working fluid is compressed and expanded and causes temperature oscillation and thermal energy flowing from one end of the stack to the other end. The thermal energy, such as cooling capacity, is finally transferred outward through the heat exchangers on sides of the stacks. The multiple stacks and heat exchangers perform a multiple stage temperature gradient. More thermal energy is transferred, and the working efficiency is improved.

11 Claims, 7 Drawing Sheets

MULTI-STAGE THERMOACOUSTIC DEVICE

BACKGROUND OF THE INVENTION

Field of the Invention

The invention generally relates to a thermoacoustic device applicable to heat pump and thermoacoustic prime mover, and particularly relates to a multi-stage thermoacoustic device including a plurality of stacks and a plurality of heat exchangers interlaid with each other so as to highly improve the system efficiency.

RELATED ART

Thermoacoustic devices are applicable to heat pumps. The composition of a thermoacoustic device includes an acoustic driver, a resonance tube, a stack and a heat exchanger. Acoustically driven fluid particles located close to surfaces within the stack undergo a reverse Brayton cycle and pump heat from cold end of the stack to the hot end. The net energy transfer occurs in the direction of fluid motion during the compression, toward the pressure antinode of the standing wave.

Reversibly, a thermoacoustic prime mover operates on the similar principle but a temperature gradient imposed at one end. An acoustic wave was generated in the resonance tube that can be transformed in to electrical power.

Generally, in a standing wave thermoacoustic device, the distance between plates of the stack is kept with 2 to 4 times of the thermal penetration depth. Further, in order to obtain thermal transference retardation between the stack and the working fluid, the stack of the thermoacoustic device has to be characterized with: 1) low impedance between the stack and the working fluid; 2) low thermal conductivity of the stack in the oscillation direction of the acoustic wave medium; 3) a larger ratio of area to volume; and 4) less thermal contact effect with the working fluid. Furthermore, the thickness of the stack influences the flow area of the working fluid in the resonance tube, so the design of stack is extremely important for a thermoacoustic device.

Referring to FIG. 1, a conventional thermoacoustic cooler includes a resonance tube 10 filled with a working fluid 11. A driver 60 is mounted on one end of the resonance tube 10. A stack 20 composed of a plurality of plates 21 is mounted inside the resonance tube 10. Two heat exchangers 30, 31 are mounted on two ends of the stack 20. The heat exchangers 30, 31 are composed of metal fins 32 and tubes 80. The fins 32 are fixed in parallel to outer surface of the tube 80 so as to perform heat exchange with the working fluid 11. The driver 60 activates acoustic oscillation to the working fluid 11 so that the fluid is compressed and expanded cyclically. As shown in FIG. 1, the driver 60 generates acoustic waves in the resonance tube 10 and causes a standing wave of half wavelength. The first and second ends of the resonance tube 10 are antinodes of pressure, while at the center of the resonance tube 10 is a pressure node. Therefore, the amplitude of pressure fluctuation at the left end of the stack 20 is higher than that of the right end. When the fluid 11 moves rightwards, it is compressed and raises its temperature. The temperature of the working fluid 11 is higher than that of the right end of the stack 20, so heat transfers from the fluid 11 to the right end of the stack 20. Here is a half cycle. Then, the working fluid 11 moves reversedly toward the left end of the stack 20 where the temperature of the fluid 11 is descended. Because the temperature of the working fluid 11 is lower than the temperature of the left end of the attack 20, it cools down the left end of the stack 20. The whole cooling cycle thus finishes. The heat exchangers 30, 31 coupled to the stack 20 then provide cooling or heating functions to exterior through heat exchange.

FIG. 2A shows the temperature gradient of a conventional thermoacoustic device. The right end of the stack 20 has a higher temperature than the left end, but shows a single stage gradient. Also, in FIG. 2B, a pressure to volume chart of the thermoacoustic device shows a single stage cycle.

In order to enhance the performance of a thermoacoustic device, a possible manner is to increase the contact area of the heat exchanger to the working fluid so as to increase heat transfer rate. According to principle of heat transfer, the capacity of heat transfer is proportional to the contact area. So, increasing the fin length of the heat exchanger should increase the thermal contact area and improve the heat transfer capacity. However, in a conventional thermoacoustic device, when over-increasing the length of the heat exchanger, the working fluid travels wholly in the region of the heat exchanger during an oscillation cycle, no cooling effect is generated since the heat exchanger is highly thermal conductive that does not perform thermal transfer retardation. Also, when the working fluid contacts more with the heat exchanger, more frictional loss occurs and lowers the performance of the whole system, too.

SUMMARY OF THE INVENTION

The object of the invention is to provide a multi-stage thermoacoustic device in which a plurality of stacks and a plurality of heat exchangers are interlaid with each other to form a multi-stage unit for replacing a conventional stack and heat exchanger unit. The inventive unit can solve the aforesaid problem of prior arts and highly improves the system efficiency of the thermoacoustic device.

A thermoacoustic device according to the invention includes a resonance tube mounted therein a plurality of stacks and a plurality of heat exchangers interlaid with each other adjacent to a second end of the resonance tube. A working fluid is filled in the resonance tube. The stacks are laid in parallel inside the resonance tube near the second end of the tube. The heat exchangers are individually interlaid between each two stacks and laid with one on the outer sides of the two end stacks. The driver is mounted on a first end of the resonance tube. Each of the stacks is composed of a plurality of plates. The stacks are placed between the pressure node and antinode inside the resonance tube for the best performance. The plates are spaced from one another to provide flow passage. Each heat exchanger is composed of a plurality of fins mounted in parallel outside tubes for providing cooling flow. The heat exchanging tube is preferably a straight or a bended tube. The maximum length of fins of each heat exchanger is preferably made with two times of the particle displacement is a cycle. Using an acoustic driver, the working fluid within the resonance tube is excited to generate an acoustic standing wave. The length of the resonance tube corresponds to half or quarter the wavelength. Due to the pressure wave, a particle will be displaced an oscillated motion. Meanwhile, the particle will also undergo pressure and temperature fluctuation.

A working fluid in resonance tube is ideally compressed and expanded adiabatically. When introducing a densely spaced stack of plates at a specified location into the acoustic field, a temperature difference develops along the stack plates. This temperature difference is caused by the thermoacoustic effect. The gas parcel in the resonance tube is cycle at a mean temperature. In the first step, the gas parcel is moved to the right towards the pressure antinode by the acoustic standing wave. Thus, it experiences adiabatic compression which causes its temperature to rise. In this state, the temperature of gas parcel is higher than the stack plate and heat transfer towards the stack palate takes place. On its way back to the initial location, the gas parcel is expansion and getting colder than the stack plates. The heat transfer from the stack plate to the gas parcel. After these steps, the gas parcel has completed on thermoacoustic cycle and a temperature gradient develops along the stack plates. The multiple stacks and heat exchangers in the resonance tube serially link to perform a multiple stage temperature variation. The contact area of the heat exchangers to the working fluid is increased, more thermal energy is transferred, and the cooling capacity is increased.

Reversibly, when working as a thermoacoustic prime mover, heat is applied through the heat exchangers to the resonance tube, the working fluid increases its temperature and generates a pressure fluctuation, so the acoustic wave is used to activate a generator and provide electrical power.

BRIEF DESCRIPTION OF THE DRAWINGS

The invention will become more fully understood from the detailed description given hereinbelow. However, this description is for purposes of illustration only, and thus is not limitative of the invention, wherein.

DETAILED DESCRIPTION OF THE INVENTION

Figure 1:
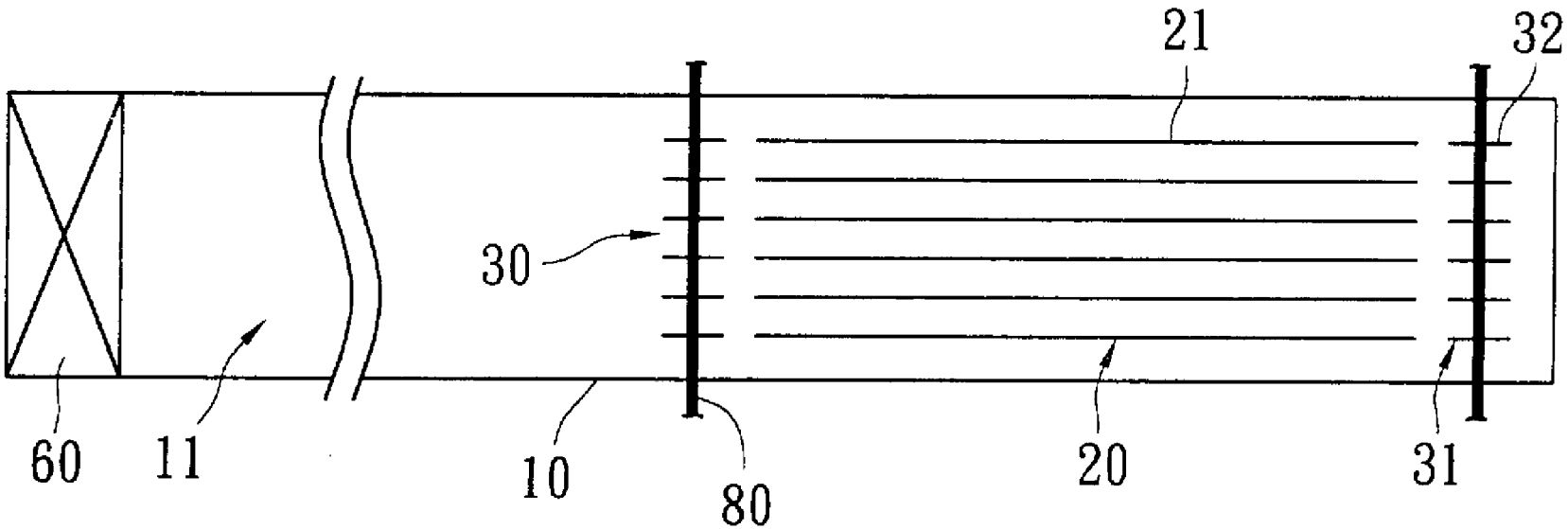
FIG. 1(PRIOR ART)
FIG. 1 is an explanatory view of a conventional thermoacoustic device.
Figure 2A:
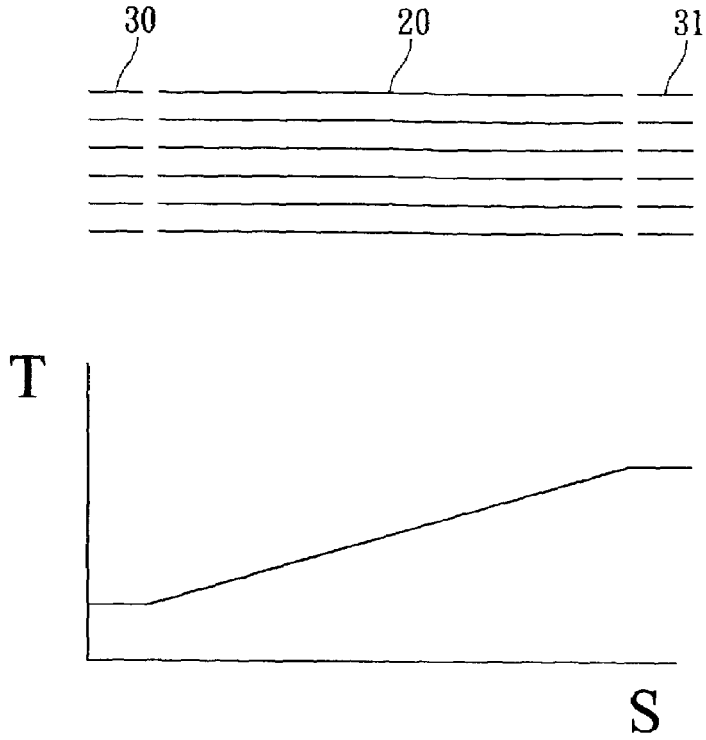
FIG. 2A (PRIOR ART)
FIG. 2A is a temperature gradient diagram of a conventional thermoacoustic device.
Figure 2B:
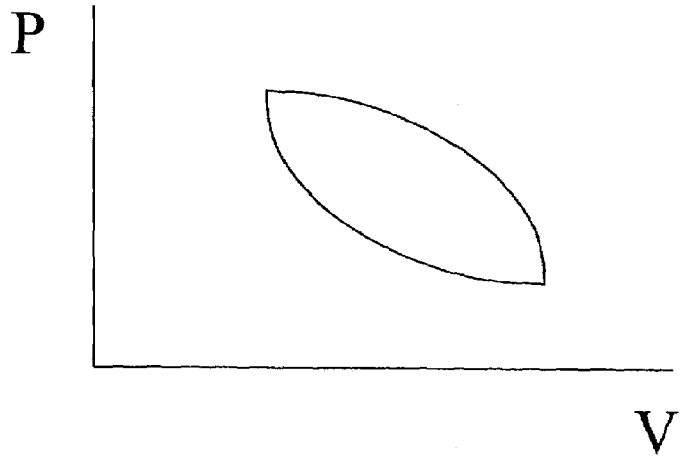
FIG. 2B (PRIOR ART)
FIG. 2B is a pressure to volume chart of a conventional thermoacoustic device.

The construction and problem of conventional thermoacoustic devices have been described above with FIG. 1 and FIGS. 2A, 2B.

Figure 3:
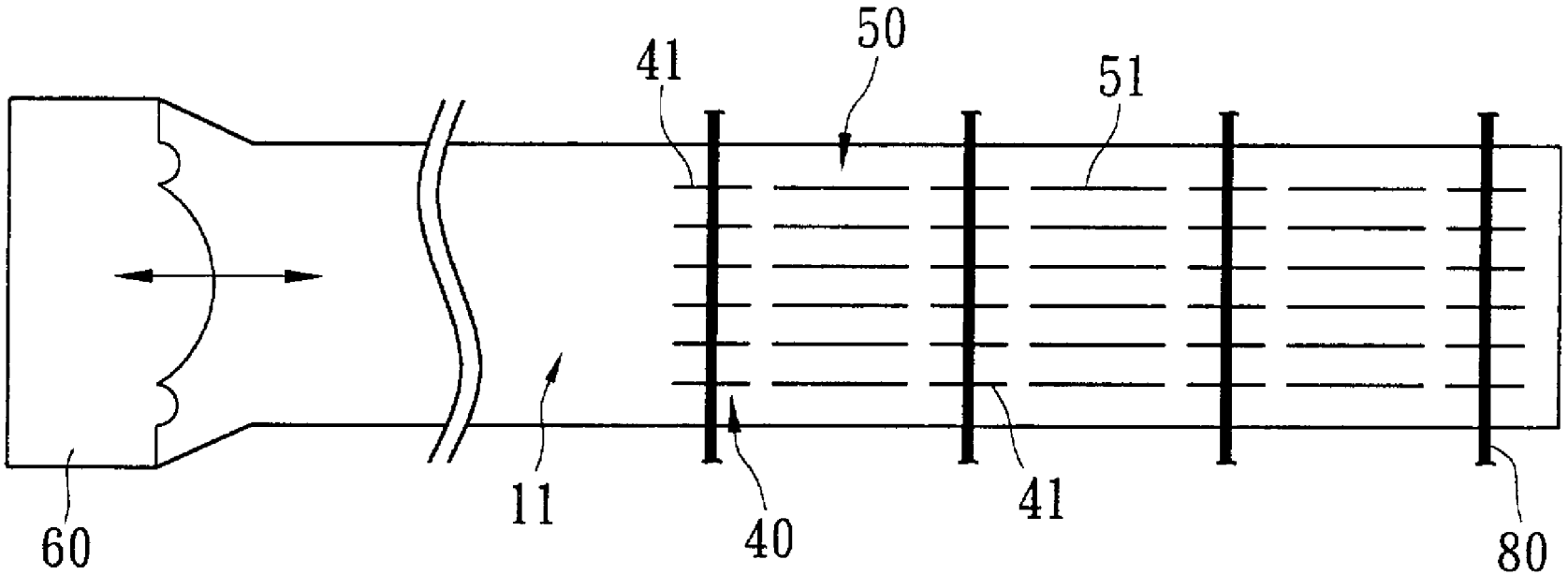
FIG. 3 is a first embodiment of a multi-stage thermoacoustic device of the invention.
Figure 5:
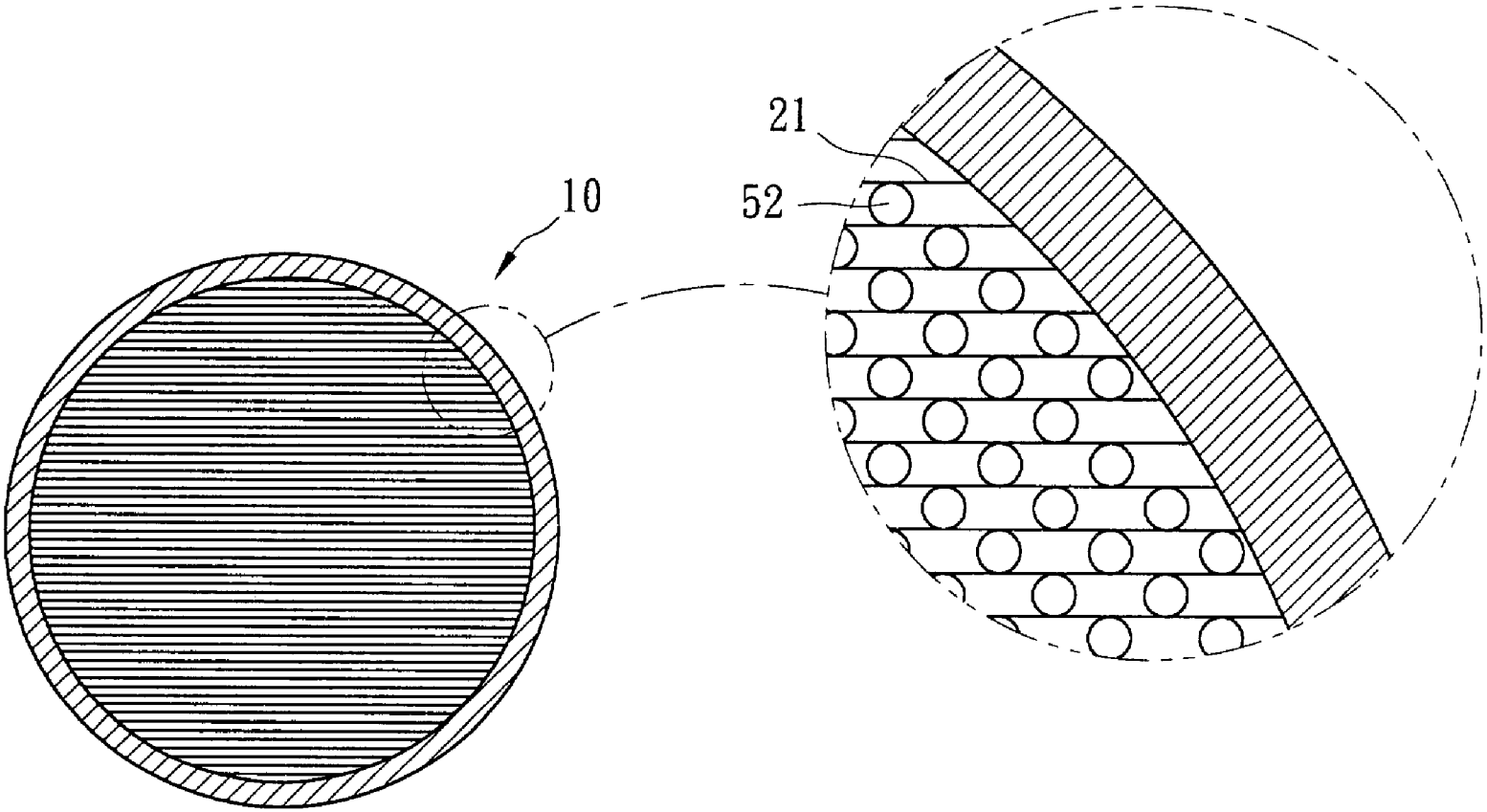
FIG. 5 is a sectional view of a stack in an embodiment of the invention.
Figure 6:
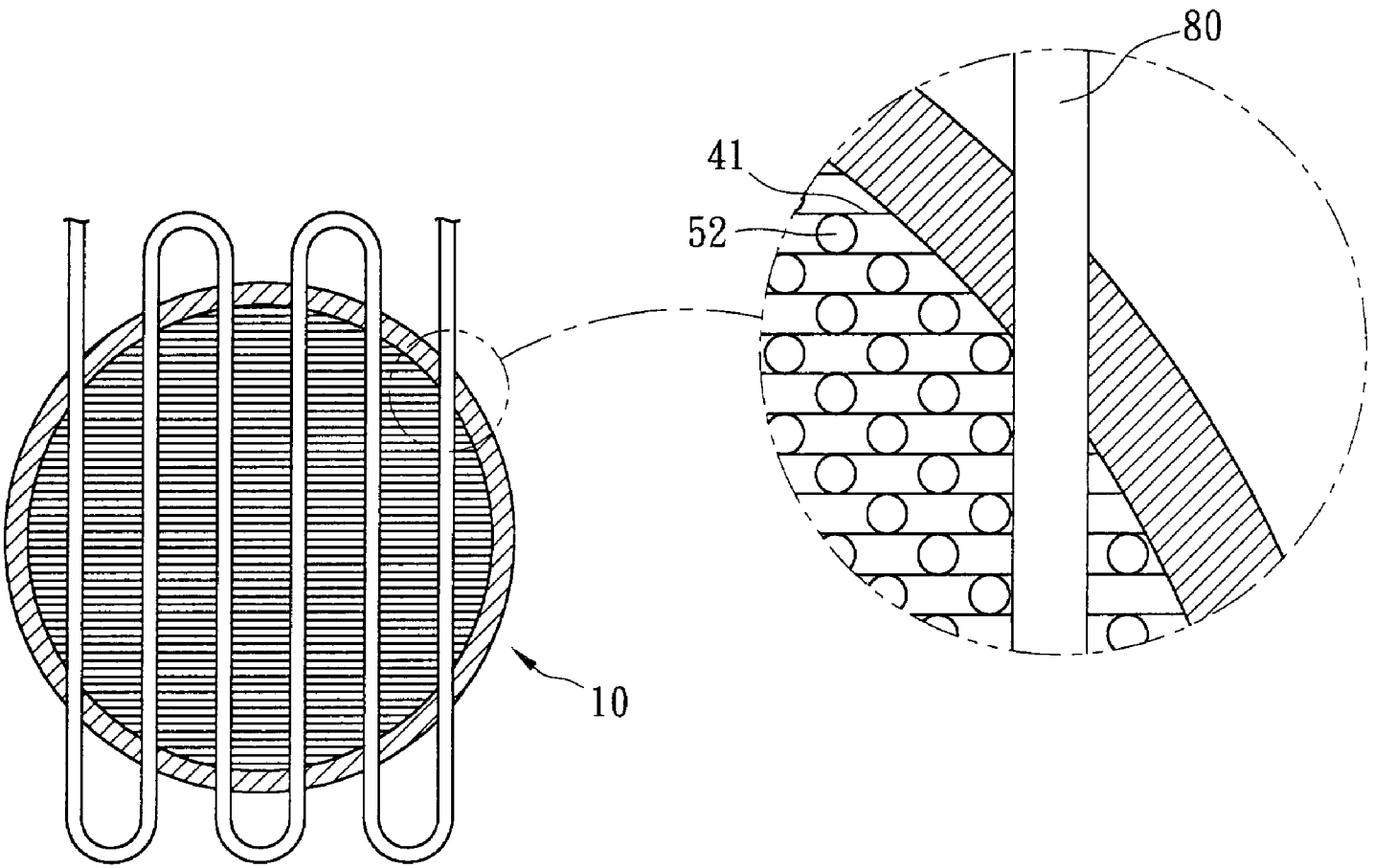
FIG. 6 is a sectional view of a heat exchanger in an embodiment of the invention.

Now referring to FIG. 3, a multi-stage thermoacoustic device of the invention includes a resonance tube 10 having a first end and a second end. A plurality of stacks 50 and a plurality of heat exchangers 40 are interlaid with each other in the resonance tube 10 adjacent to the second end. A working fluid 11 is filled in the resonance tube 10. A driver 60 is mounted on the first end of the resonance tube 10. The stacks 50 are laid in parallel inside the resonance tube 10 near the second end of the tube. Each of the stacks is composed of a plurality of plates 51. Preferably, at least a supporting element 52, as shown in FIG. 5, is formed space between the plate 51 of the stack 50 to provide passage for the working fluid 11. The heat exchangers 40 are individually mounted on both sides of the stacks 50. Each heat exchanger 40 is composed of a plurality of fins 41 mounted in parallel outside tubes 80 for providing cooling flow. The working fluid can flow through the fins after stacks. The heat exchanging tubes 80 is preferably straight or bended tubes. As shown in FIG. 5 and FIG. 6, sectional views of an embodiment of a stack 50 and a heat exchanger 40, the stack 50 and the heat exchanger 40 are made corresponding to the shape of the resonance tube 10. The stacks 50 and the heat exchangers 40 are interlaid with each other and fixed to the inner wall of the resonance tube 10. When the driver 60 activates the working fluid 11 oscillate in the resonance tube 10, the working fluid 11 is compressed and expanded and causes temperature variation. When the working fluid is compressed, the temperature increases; when the working fluid is expanded, the temperature decreases. The stacks 50 are placed between the node and antinode of the resonance tube 10. The length of fins 41 of each heat exchanger 40 is preferably made with two times of oscillation amplitude of the working fluid 11. The reason for this length is that a smaller length of the heat exchanger 40 will lose a best heat transfer since the thermal energy carried by the stack 50 from the working fluid will pass outside the range of the heat exchanger. On the other hand, when the length of the heat exchanger 40 is too large, the working fluid 11 travels only in the region of the heat exchanger 40 during an oscillation cycle, no cooling effect is generated since the heat exchanger 40 is highly thermal conductive that does not perform thermal transfer retardation. Also, when the working fluid 11 contacts more with the heat exchanger 40, more frictional loss occurs and lowers the performance of the whole system, too. As an experimental result, a preferable length of the heat exchanger 40 is twice the oscillation amplitude of working fluid 11.

When the driver 60 activates, the working fluid 11 oscillates in the resonance tube 10. As the working fluid 11 passes the stacks 50, the working fluid 50 is compressed and increases its temperature. Since there are thermal transfer retardation between the working fluid 11 and the rigid boundary of the stacks 50, temperature variations exist between the working fluid 11 and the ends of the stacks 50, therefore, thermal energy flows from one end of the stack 50 to the other end. The heat is thus removed outwards through the heat exchanging tube 80 of the heat exchanger 40. Then, the working fluid 11 moves toward the other end of the stacks 50, expands and lowers its temperature. Therefore, it absorbs thermal energy at the other end of the stacks 50. The thermal energy is transferred through the heat exchanging tube 80 of the other side heat exchanger 40 and provides cooling effects outwards. The multiple stacks 50 and heat exchangers 40 provides multiple stage heat transference that is much more efficient than a conventional single stage device when being activated by a same driver 60.

Figure 4A:
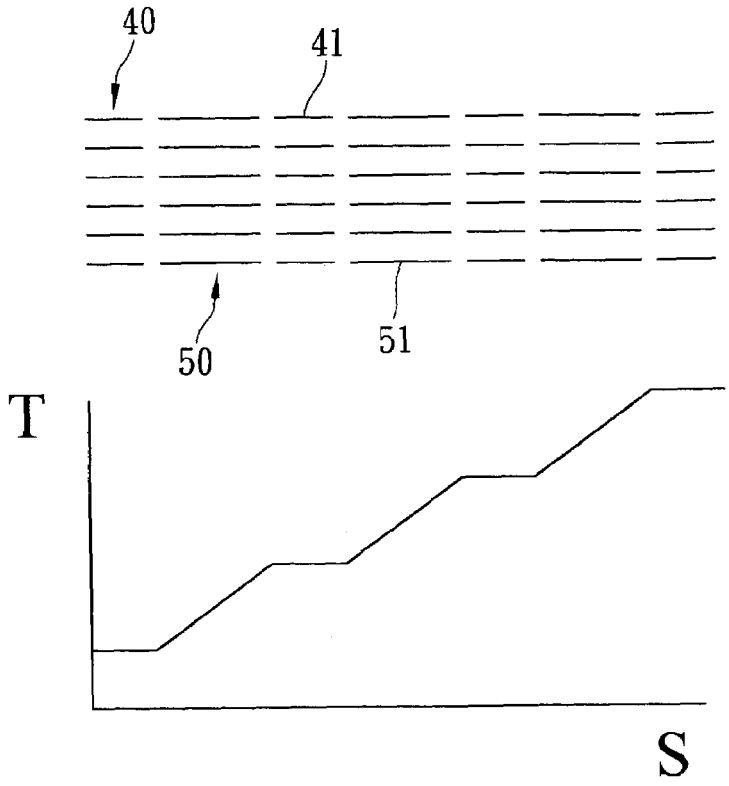
FIG. 4A is a temperature gradient diagram of a multi-stage thermoacoustic device of the invention.
Figure 4B:
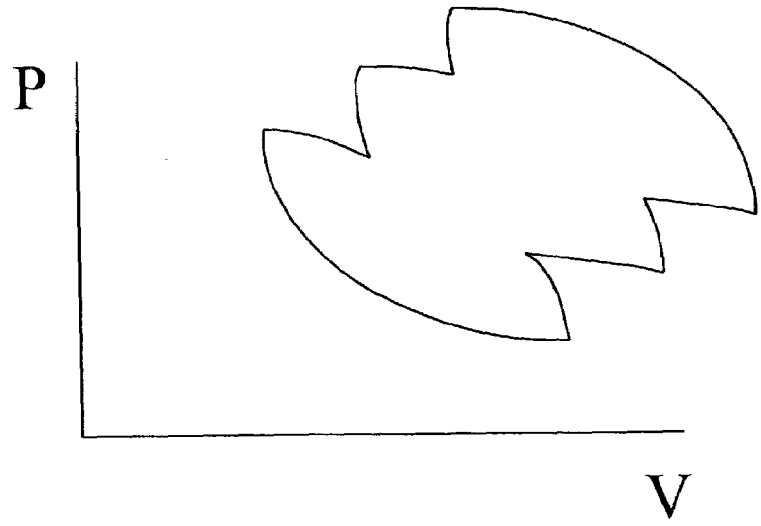
FIG. 4B is a pressure to volume chart of a multi-stage thermoacoustic device of the invention.

FIG. 4A is a temperature gradient diagram of a multi-stage thermoacoustic device of the invention. As described above, the multiple stacks 50 and the multiple heat exchangers interlaid inside the resonance tube 10 perform heat transference with the working fluid 11 when the working fluid 11 is compressed and expanded cyclically. As shown in FIG. 4A, the temperature at right end of the stacks 50 is higher than that of the left end and a multi-stage gradient is performed. That means there are multiple heat transference in the stacks 50, the multi-stage stacks and heat exchangers transfer much more thermal energy. Also, in FIG. 4B, a pressure to volume chart of a multi-stage thermoacoustic device of the invention shows that the multi-stage stacks and heat exchangers provide multi-stage heat transference by the multiple thermal cycles occurring in the larger-area contacts of the working fluid to the heat exchangers. Therefore, the multi-stage working area highly improves the efficiency of the thermoacoustic device.

Figure 7:
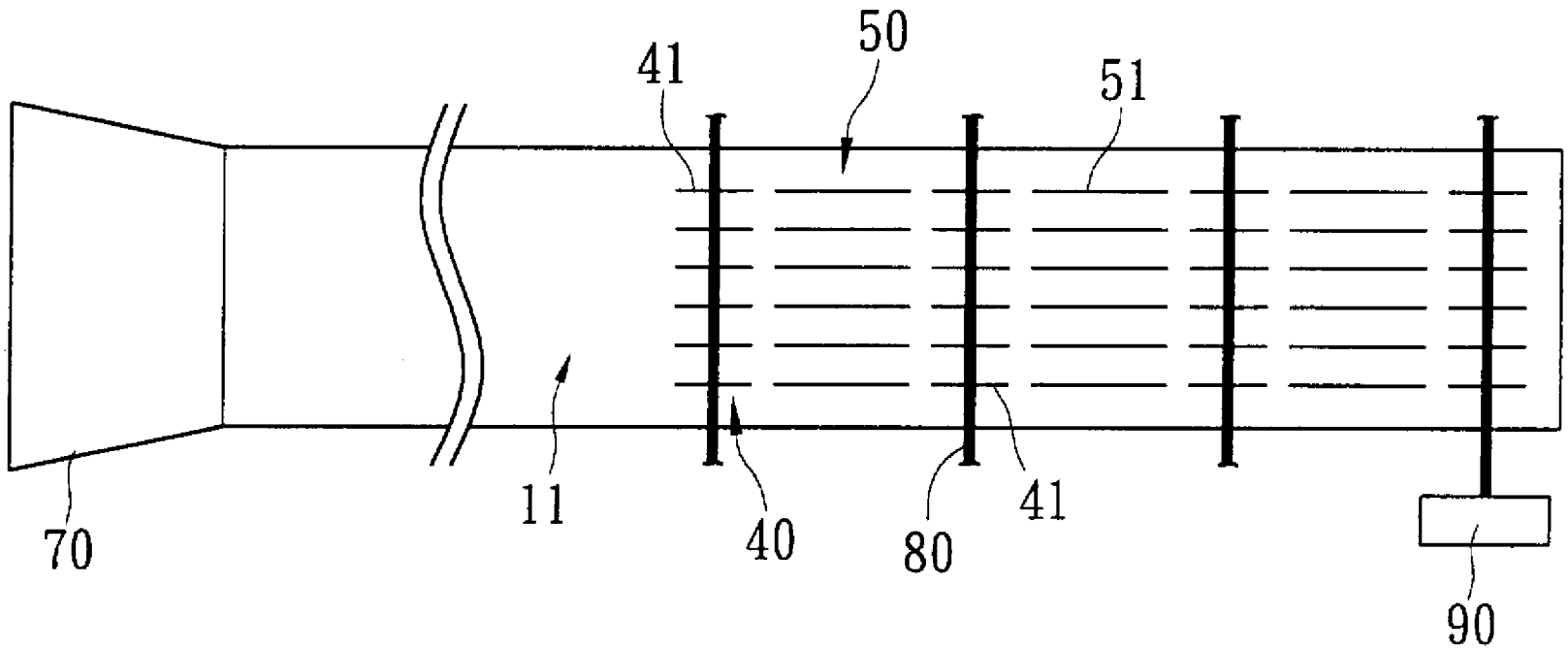
FIG. 7 is an explanatory view of a second embodiment of the invention.

The thermoacoustic device of the invention is not only applicable for a cooling device, but also applicable for generating electrical output from a thermal input. As shown in FIG. 7, a second embodiment of the invention, a heater 90 is accompanied with the resonance tube 10 for providing thermal energy to the heat exchanger 40. The heat transfers to the working fluid 11 in the resonance tube 10 makes the working fluid expand and fluctuate. In other words, the working fluid 11 oscillates in the resonance tube 10 just like the effect of the driver 60 in the first embodiment of the invention that activates the working fluid 11. Then, the oscillation of the working fluid 11 drives an electric generator 70 for generating electrical power output. In the embodiment, the multi-stage stacks and heat exchangers provide multi-stage thermal transference and also improve the efficiency of power generation.

In conclusion, the invention provides a thermoacoustic device that includes multiple stacks and heat exchangers. In comparison with conventional thermoacoustic devices with single-stage stack and heat exchanger, the thermoacoustic device of the invention increases the working area and highly improves the thermal transfer efficiency. The construction is rather simple and inexpensive. When using as a cooling device, there is no need of refrigerant and compressor, the lifetime is lengthen and there is no noise suffering.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-stage thermoacoustic device comprising:

a resonance tube, having a first end and a second end, filled with a working fluid capable of receiving an input energy and oscillating in said resonance tube;

a plurality of stacks, mounted on said second end of said resonance tube, and allowing said working fluid passing through; and a plurality of heat exchangers, interlaid with said stacks, for transferring thermal energy of said stacks outwards, said stacks being laid between a node and an antinode of acoustic wave of pressure oscillation of said working fluid in said resonance tube and the heat exchanger having fins, each of the fins having a length which is twice an amplitude of displacement oscillation.

2. The multi-stage thermoacoustic device according to claim 1, wherein said input energy is acoustic energy.

3. The multi-stage thermo acoustic device according to claim 2, wherein said acoustic energy is provided by a driver.

4. The multi-stage thermoacoustic device according to claim 3, wherein said driver is mounted on the first end of said resonance tube.

5. The multi-stage thermoacoustic device according to claim 1, wherein said stacks are composed of a plurality of plates.

6. The multi-stage thermoacoustic device according to claim 5, further comprising at least a supporting element formed among said plates for supporting said stacks.

7. The multi-stage thermoacoustic device according to claim 5 or 6, wherein said stacks are fixed to inner wall of said resonance tube.

8. The multi-stage thermoacoustic device according to claim 1, wherein each of said heat exchangers comprises a plurality of the fins, with the fins being plate-like heat exchanging fins fixedly mounted in parallel on an outer surface of a heat exchanging tube.

9. The multi-stage thermoacoustic device according to claim 8, wherein said heat exchanging fins are laid in parallel to said plates of stacks.

10. The multi-stage thermoacoustic device according to claim 1, wherein a sectional shape of said stacks and heat exchangers corresponds to a sectional shape of said resonance tube.

11. The multi-stage thermoacoustic device according to claim 10, wherein the sectional shape of said resonance tube is round.

* * * * *